US005341786A

United States Patent [19]

Abe et al.

[11] Patent Number: 5,341,786

[45] Date of Patent: Aug. 30, 1994

[54] FUEL INJECTION CONTROL DEVICE FOR INTERNAL COMBUSTION ENGINE

[75] Inventors: Masahiko Abe; Yasuo Iwata; Shoji Masuda, all of Saitama, Japan

[73] Assignee: Honda Giken Kogyo Kabushiki Kaisha, Tokyo, Japan

[21] Appl. No.: 955,998

[22] Filed: Oct. 2, 1992

[30] Foreign Application Priority Data

Oct. 3, 1991 [JP] Japan ..... 3-282037
Oct. 3, 1991 [JP] Japan ..... 3-282038

[51] Int. Cl.[5] ..... F02D 41/10
[52] U.S. Cl. ..... 123/486; 123/492
[58] Field of Search ..... 123/492, 478, 480, 486

[56] References Cited

U.S. PATENT DOCUMENTS 3,971,354 7/1976 Luchaco et al. ..... 123/179.15
4,440,136 4/1984 Denz et al. ..... 123/492
4,495,925 1/1985 Hasegawa ..... 123/480
4,513,722 4/1985 Hasegawa ..... 123/492

FOREIGN PATENT DOCUMENTS 0066727 12/1982 European Pat. Off. .
0199457 10/1986 European Pat. Off. .
3010583 10/1980 Fed. Rep. of Germany .
59-176427 10/1984 Japan .
60-90933 5/1985 Japan ..... 123/478
63-14173 3/1988 Japan .

*Primary Examiner*—Andrew M. Dolinar

[57] ABSTRACT

A fuel injection control device controls the calculated fuel injection quantity depending upon the load condition of the engine such that the fuel injection quantity demanded by the engine can be established. This fuel injection quantity is determined based upon engine speed, intake air temperature, engine temperature, the atmospheric pressure of the intake air, and the throttle opening. When the detected intake air temperature is high for a high load condition of the engine, an intake air temperature correction factor is set such that the intake air temperature is less influential upon the establishment of the fuel injection quantity. Moreover, during acceleration, an acceleration incremental fuel injection quantity is calculated based upon different water temperature correction factors. When an engine temperature is low, the fuel injection quantity demanded by the engine is very large. Accordingly, the fuel injection control device utilizes a second water temperature correction factor which is set to be larger than a first water temperature correction factor at low engine temperatures. Thus, the fuel injection quantity for acceleration of the engine at low engine temperatures can be established in accordance with the demand by the engine.

18 Claims, 11 Drawing Sheets

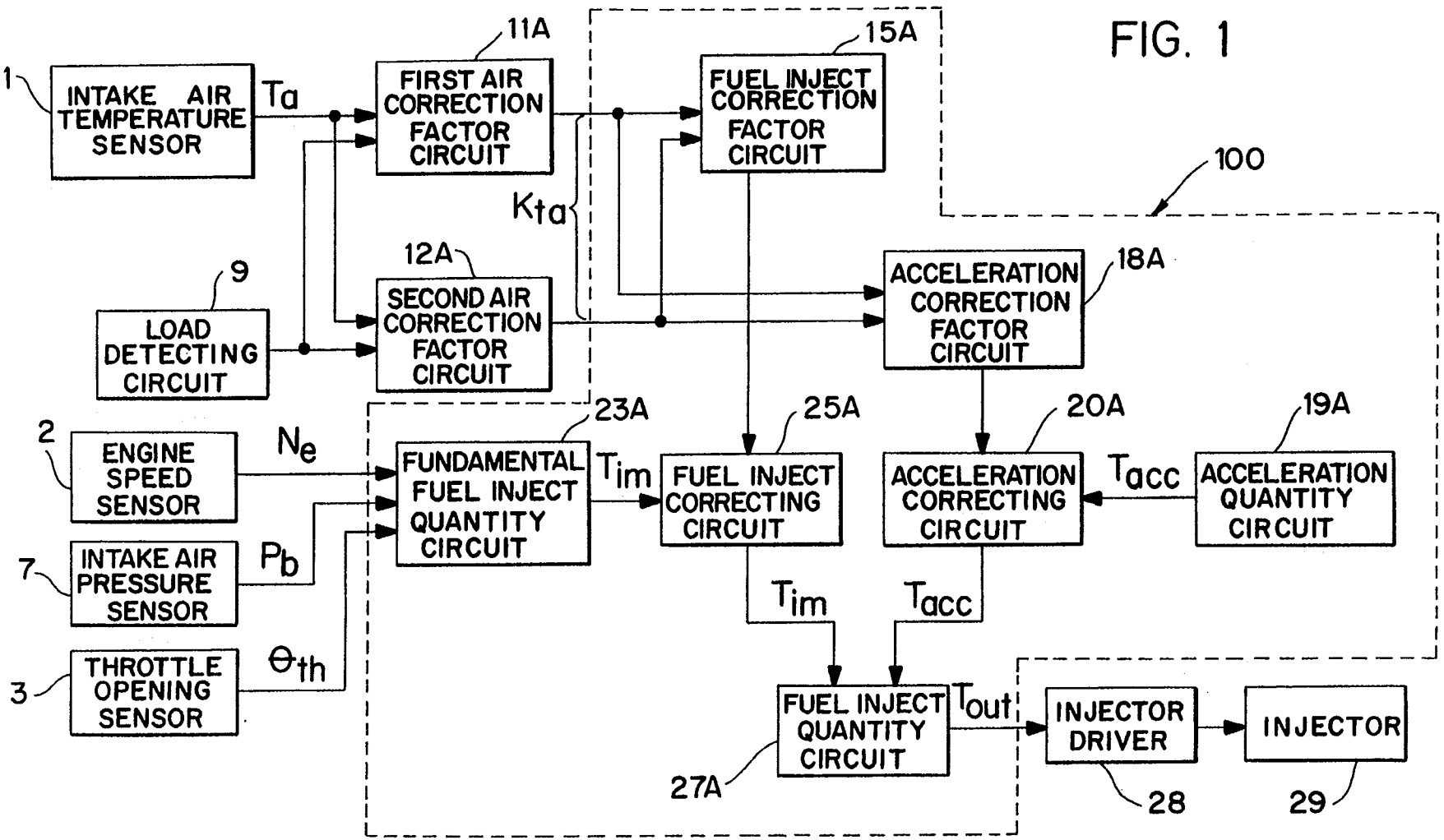
FIG. 1
100
INTAKE AIR TEMPERATURE SENSOR
1
Ta
LOAD DETECTING CIRCUIT
9
ENGINE SPEED SENSOR
2
Ne
INTAKE AIR PRESSURE SENSOR
7
Pb
THROTTLE OPENING SENSOR
3
θth
FIRST AIR CORRECTION FACTOR CIRCUIT
11A
SECOND AIR CORRECTION FACTOR CIRCUIT
12A
Kta
FUEL INJECT CORRECTION FACTOR CIRCUIT
15A
ACCELERATION CORRECTION FACTOR CIRCUIT
18A
ACCELERATION QUANTITY CIRCUIT
19A
Tacc
ACCELERATION CORRECTING CIRCUIT
20A
Tacc
FUNDAMENTAL FUEL INJECT QUANTITY CIRCUIT
23A
Tim
FUEL INJECT CORRECTING CIRCUIT
25A
Tim
FUEL INJECT QUANTITY CIRCUIT
27A
Tout
INJECTOR DRIVER
28
INJECTOR
29

FUEL INJECTION CONTROL DEVICE FOR INTERNAL COMBUSTION ENGINE

FIELD OF THE PRESENT INVENTION

The present invention relates to a fuel injection control device for an internal combustion engine, and more particularly, to a fuel injection control device for an internal combustion engine wherein a fuel injection quantity is controlled according to an intake air temperature. Moreover, the present invention relates to a fuel injection control device for an internal combustion engine wherein an acceleration incremental injection quantity is set during acceleration of the internal combustion engine, and the fuel injection quantity is controlled by using the acceleration incremental injection quantity.

BACKGROUND OF THE PRESENT INVENTION

Conventionally, various fuel injection control devices for internal combustion engines have been designed. For example, in Japanese Patent Laid Open Publication Number 59-176427, a fuel injection control device has been developed to control a fuel injection quantity according to an intake air temperature. The fuel injection quantity is corrected, so as to compensate for a difference in density of the intake air due to a temperature difference thereof. The correction value of the fuel injection quantity according to the intake air temperature is determined based upon an output signal from an intake air temperature sensor provided in an air cleaner, for example. While idling or running with a very low load with respect to the internal combustion engine, the intake air flow is relatively small, and thus, the temperature of a temperature detecting portion of the intake air temperature sensor accurately corresponds with the actual intake air temperature.

On the other hand, when the engine becomes hot as in a high load condition, the temperature of the temperature detecting portion of the intake air temperature sensor can read a very high temperature due to the influence of the high ambient temperature around the sensor even though the actual intake air temperature is not as high due to the large intake air flow. More specifically, when an intake air temperature is detected by the intake air temperature sensor during a high load condition, the detected intake air temperature is actually higher than the actual intake air temperature.

As a result, if the corrected value of the fuel injection quantity is determined based upon the detected intake air temperature only, a problem exists such that the fuel injection quantity according to the detected intake air temperature during a high load condition is different from a fuel injection quantity which would be corrected on demand by the engine if the actual intake air temperature was detected.

Another example of a fuel injection control device for an internal combustion engine is set forth in Japanese Patent Publication Number 63-14173. This fuel injection control device improves in acceleration performance by increasing a fuel injection quantity during acceleration of an internal combustion engine. This technique utilizes a threshold value for determining acceleration that is variable according to engine temperature. The fuel injection quantity is increased according to the determination of the acceleration.

In contrast, another technique for adjusting the acceleration incremental injection quantity according to an engine temperature utilizes a water temperature correction factor. In this technique, a fuel injection quantity, during normal running of an engine, is usually corrected by utilizing a water temperature correction factor set according to an engine temperature. The acceleration incremental injection quantity is corrected utilizing this water temperature correction factor.

However, utilizing such a correction technique, the fuel injection quantity for normal running of an internal combustion engine and the acceleration incremental injection quantity are corrected utilizing the same water temperature correction factor. In other words, the temperature correction factor used during normal running of an internal combustion engine is used during acceleration or transient running of the engine. Accordingly, this type of correction technique is not desirable in a motorcycle in which acceleration performance is considered an important feature. More specifically, when utilizing this correction technique, the fuel injection quantity which is computed utilizing the correction factors stated above, it is quite different from the actual fuel injection quantity demanded by the engine.

OBJECTS IN SUMMARY OF THE PRESENT INVENTION

It is an object of the present invention to provide a fuel injection control device for an internal combustion engine wherein the fuel injection quantity for a high load condition is in accord with that actually demanded by the engine. It is another object of the present invention to provide a fuel injection control device for internal combustion engine wherein the fuel injection quantity during acceleration is in accord with that demanded by the engine.

According to one embodiment of the present invention, an intake air temperature correction factor is set according to an intake air temperature and whether the internal combustion engine is in a low load condition or a high load condition. Furthermore, after the intake air temperature exceeds a predetermined temperature, the intake air temperature correction factor set for the high load condition is less influenced by the intake air temperature than the intake air temperature correction factor when set for the low load condition. The intake air temperature correction factor set for the high load condition may be a fixed value after the intake air temperature exceeds the predetermined temperature.

When an internal combustion engine is at a high load condition, and the intake air temperature is greater than a predetermined temperature, the intake air temperature correction factor is set to be less influenced by the intake air temperature.

According to another embodiment of the present invention, a fuel injection control device for an internal combustion engine controls a fuel injection quantity utilizing a water temperature correction factor. A fundamental fuel injection quantity represented by the fuel injection quantity during normal running of the engine and an acceleration incremental injection quantity represented by an increment in the fuel injection quantity during acceleration of the engine are corrected by utilization of a water temperature correction factor which corresponds to the engine temperature (cooling water temperature). A fuel injection quantity is set by utilizing corrected values for the fundamental fuel injection quantity in the acceleration incremental injection quantity. The water temperature correction factor includes a first water temperature correction factor which corrects the fundamental fuel injection quantity and a second water temperature correction factor which corrects the acceleration incremental injection quantity.

The first water temperature correction factor and the second water temperature correction factor decrease with an increase in engine temperature such that a rate of decrease in the second water temperature correction factor is set to be larger than a rate of decrease in the first water temperature correction factor.

The correction of the fundamental fuel injection quantity and the acceleration incremental injection quantity can be performed utilizing the different water temperature correction factors. Further, as a rate of decrease in the second water temperature correction factor with an increase in engine temperature is set to be larger than that of the first water temperature correction factor, the second water temperature correction factor can be set to be greater than the first water temperature correction factor at low engine temperatures.

BRIEF DESCRIPTION OF THE DRAWINGS

Other objects and advantages of the present invention will become more apparent from the detailed description of the preferred embodiments with reference to the accompanying drawings wherein:

FIG. 1 is a block diagram of one embodiment of the present invention;

DETAILED DESCRIPTION OF THE PREFERRED EMBODIMENTS OF THE PRESENT INVENTION

Figure 2:
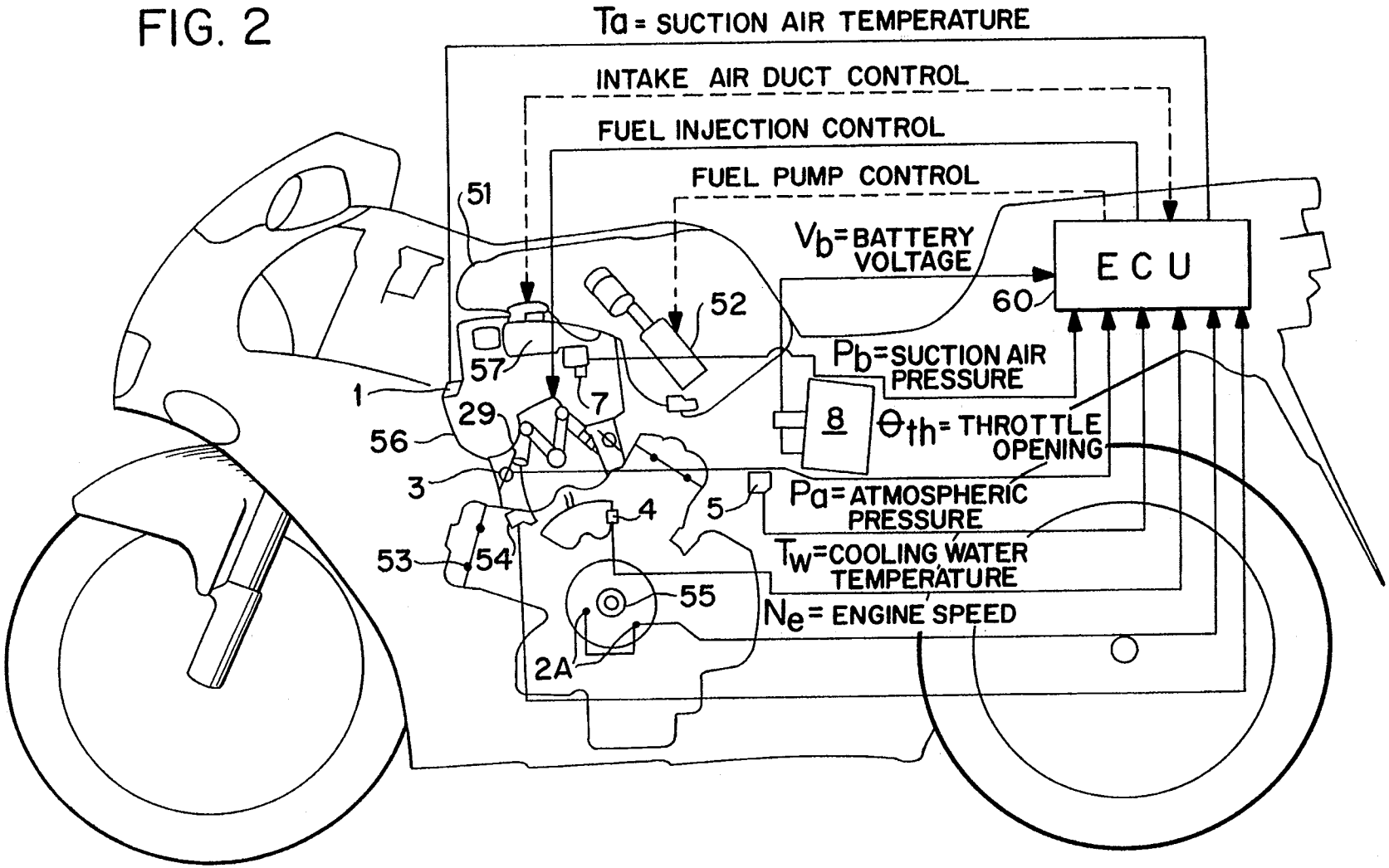
FIG. 2 is a schematic diagram of the overview of the present invention.

In the drawings, like reference numerals designate like parts throughout the drawings.

FIG. 2 is a schematic drawing of the preferred embodiment of the present invention. In FIG. 2, an air cleaner 56 is provided in the vicinity of the engine. Within the air cleaner 56, an intake air temperature sensor 1 is positioned to detect the intake air temperature $T_a$. Also, in the air cleaner 56 is an intake air pressure sensor 7 for detecting the intake air pressure $P_b$. An air inlet for the air cleaner 56 is provided at a side portion of the air cleaner 56.

A throttle valve is provided in the intake air passage leading from the air cleaner 56 to the engine. An injector 29 is provided in the vicinity of the throttle valve. A throttle opening sensor 3 for detecting a throttle opening $\theta_{th}$ is connected to a rotating shaft of the throttle valve.

The engine is provided with a cooling water temperature sensor 4 for detecting a cooling water temperature $T_w$. The engine is also provided with a crank pulser to be located in the vicinity of a crank shaft 55 for generating crank pulses to compute the engine speed $N_e$ and execute a crank interruption process. Lastly, the engine includes a cam pulser 54 located in the vicinity of a cam shaft 53 for generating $T_{dc}$ pulses.

Output signal from the above sensors and pulsers are inputted into an electronic control unit (ECU) 60. Furthermore, an atmospheric pressure $P_a$ outputted from an atmospheric pressure sensor 5 and a voltage of a battery 8 ($V_b$) are also inputted to the electronic control unit 60. The ECU 60 is provided with a microcomputer to compute a fuel injection quantity $T_{out}$ utilizing the method described above and controls the injector 29 through the utilization of the fuel injection quantity $T_{out}$.

Although not directly related to the present invention, the ECU 60 also performs control functions with respect to a fuel pump 52 provided in a fuel tank 51 and control functions with respect to an opening of an intake air duct 57 provided in the air cleaner 56.

Figure 3:
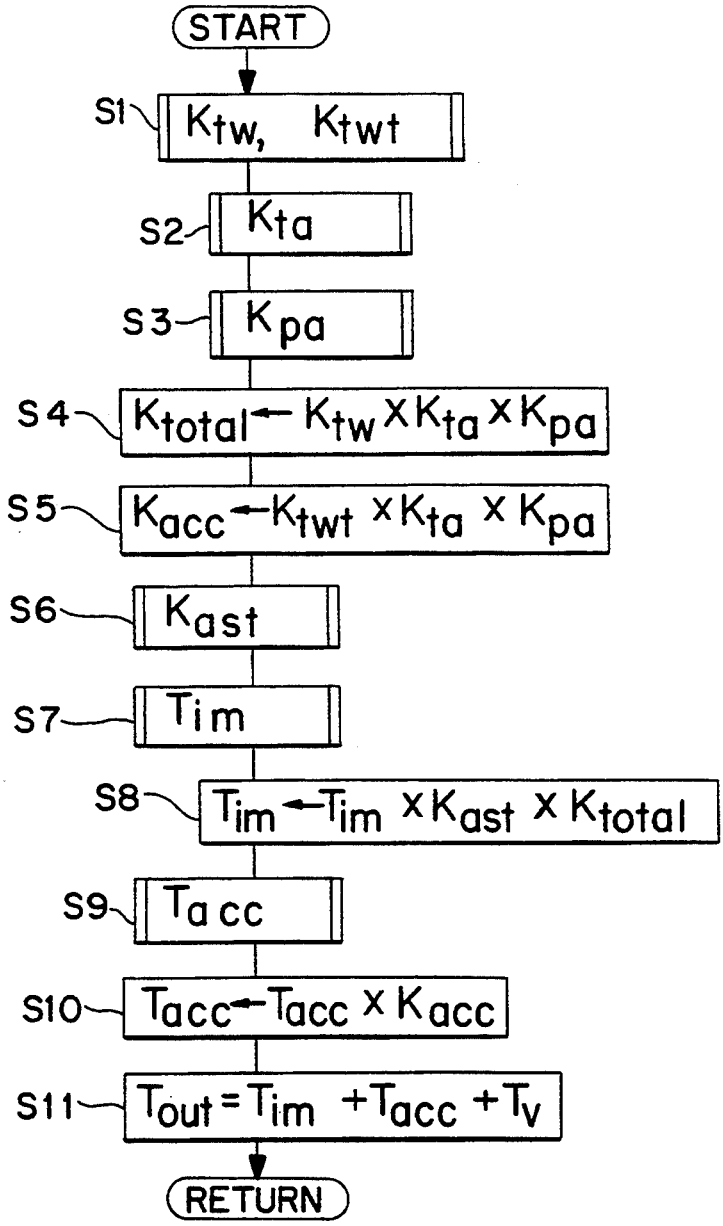
FIG. 3 is a flow chart illustrating the operations of one preferred embodiment of the present invention.

The operation of a preferred embodiment of the present invention will be described in detail with reference to FIG. 3. The process illustrated in FIG. 3 is executed upon an interruption of the crank pulses. It is noted that the various symbols referred to below correspond to the following values. More specifically, $T_{out}$ represents a fuel injection quantity; $T_{im}$ represents a fundamental fuel injection quantity; $K_{total}$ represents a first fundamental fuel injection quantity correction factor; $K_{tw}$ represents a first water temperature correction factor; $K_{ta}$ represents an intake air temperature correction factor; $K_{pa}$ represents an atmospheric pressure control factor; $K_{ast}$ represents a second fundamental fuel injection quantity correction factor; $T_{acc}$ represents an acceleration incremental fuel injection quantity; $K_{acc}$ represents an acceleration incremental injection quantity correction factor; $K_{twt}$ represents a second water temperature correction factor; and $T_v$ represents a voltage incremental injection quantity.

Figure 4:
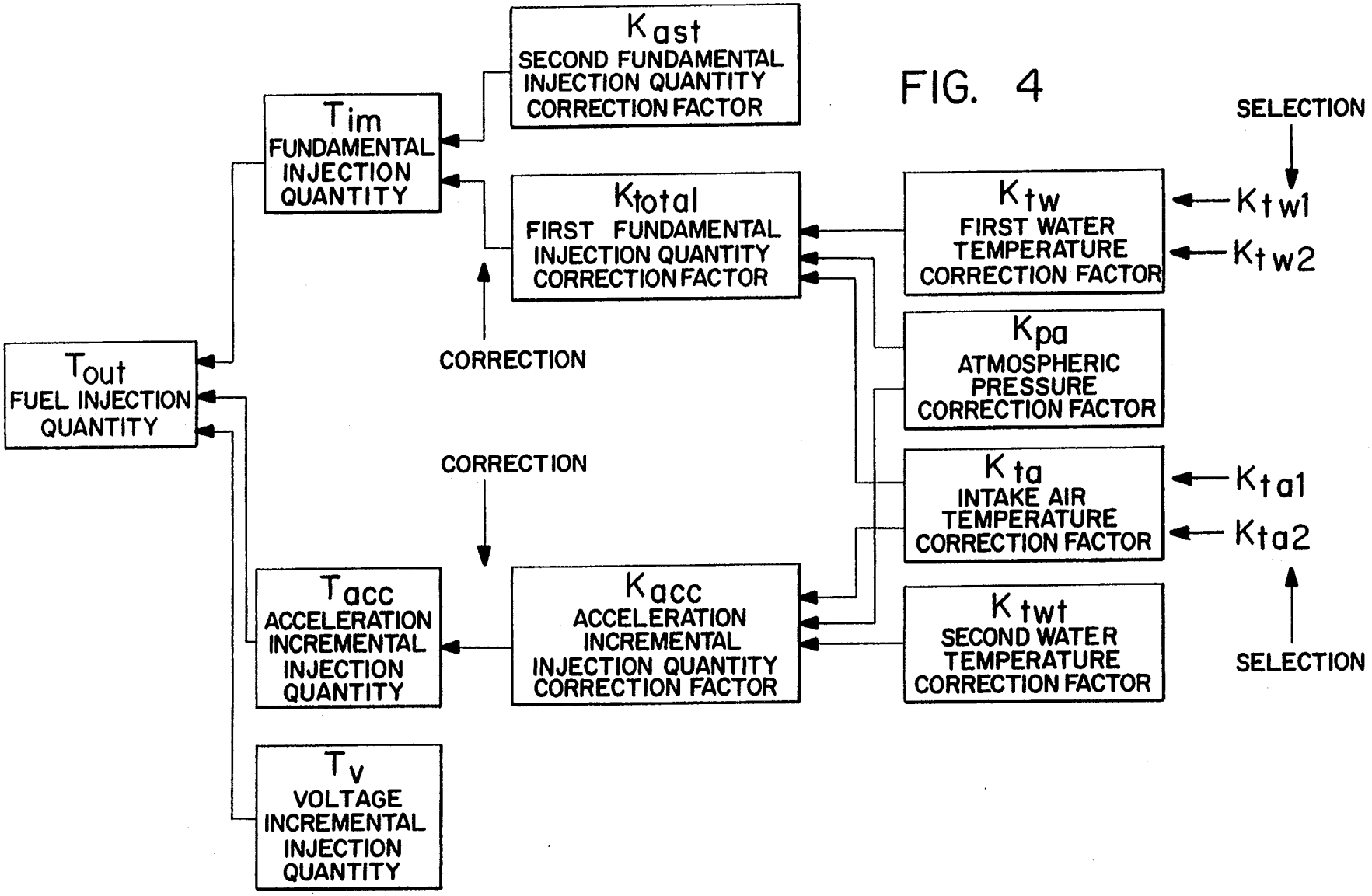
FIG. 4 is a block diagram illustrating the various symbols to be utilized in the description of the present invention and schematically illustrating a process for calculating a fuel injection quantity $T_{out}$.

As schematically shown in FIG. 4, the fuel injection quantity $T_{out}$ is calculated from the fundamental fuel injection quantity $T_{im}$, the acceleration incremental fuel injection quantity $T_{acc}$, and the voltage incremental injection quantity $T_v$. The fundamental fuel injection quantity $T_{im}$ is corrected utilizing the first fundamental fuel injection quantity correction factor $K_{total}$ and the second fundamental fuel injection quantity correction factor $K_{ast}$. The acceleration incremental fuel injection quantity $T_{acc}$ is corrected by utilizing the acceleration incremental fuel injection quantity correction factor $K_{acc}$. Furthermore, the first fundamental fuel injection quantity correction factor $K_{total}$ is calculated by using the first water temperature correction factor $K_{tw}$, the intake air temperature correction factor $K_{ta}$, and the atmospheric pressure correction factor $K_{pa}$. The acceleration incremental injection quantity correction factor $K_{acc}$ is calculated by utilizing the second water temperature correction factor $K_{twt}$, the intake air temperature correction factor $K_{ta}$, and the atmospheric pressure correction factor $K_{pa}$. The intake air temperature correction factor $K_{ta}$ is calculated from either a $K_{ta1}$ Table or a $K_{ta2}$ Table according to the load condition of the engine. Similarly, the first water temperature correction factor $K_{tw}$ is also calculated from either a $K_{tw1}$ Table or a $K_{tw2}$ Table corresponding to the load condition of the engine.

Figure 5:
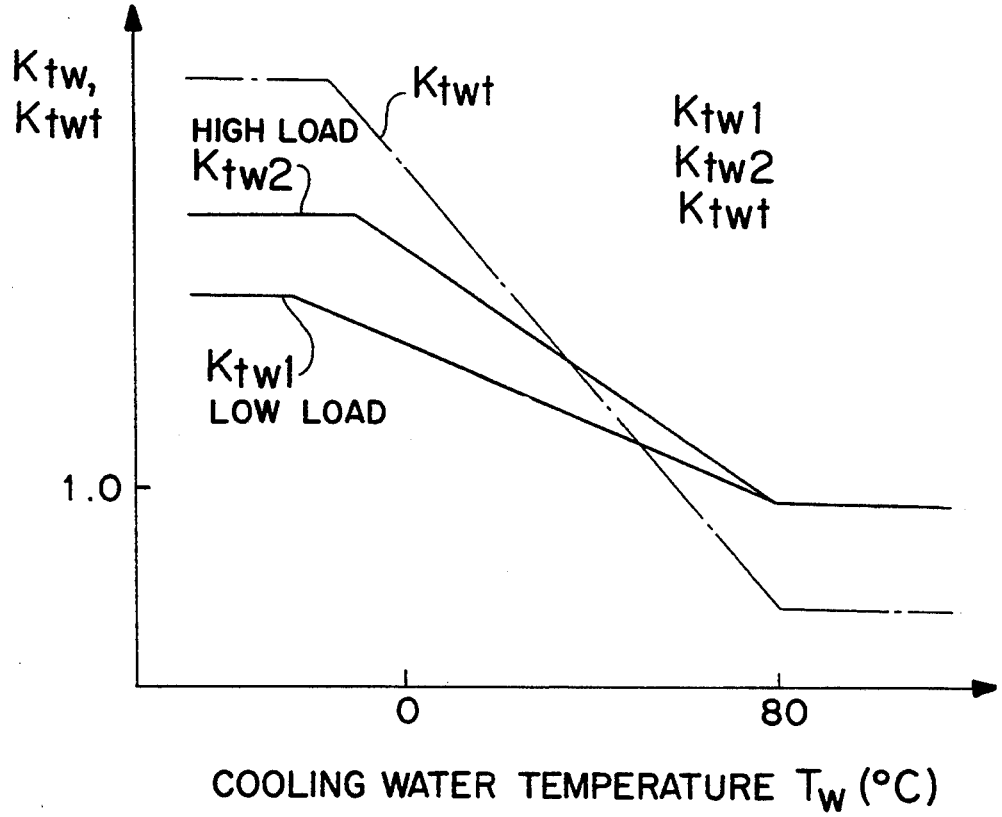
FIG. 5 is a graph illustrating the contents of $K_{tw1}$ Table, $K_{tw2}$ Table, and $K_{twt}$ Table.

Referring to FIG. 3, the first water temperature correction factor $K_{tw}$ and the second water temperature correction factor $K_{twt}$ are calculated in step S1. More specifically, a line $K_{tw1}$ and a line $K_{tw2}$ shown by solid lines at FIG. 5 is selected according to the load condition of the engine (a low load or a high load). $K_{tw1}$ data and $K_{tw2}$ data is read according to a cooling water temperature $T_w$ from the line $K_{tw1}$ or the line $K_{tw2}$ wherein this data is set to the first water temperature correction factor $K_{tw}$. Similarly, $K_{twt}$ data read according to the cooling water temperature $T_w$ from the line $K_{twt}$ shown by the dotted line in FIG. 5 is set to the second water temperature correction factor $K_{twt}$.

As illustrated in FIG. 5, all the lines $K_{tw1}$, $K_{tw2}$, and $K_{twt}$ are set so that the values at $K_{tw1}$, $K_{tw2}$, and $K_{twt}$ decrease with an increase in $T_w$. In a preferred embodiment of the present invention, the slope of the line $K_{twt}$ is set to be larger than the slopes of the lines $K_{tw1}$ and $K_{tw2}$.

Figure 6:
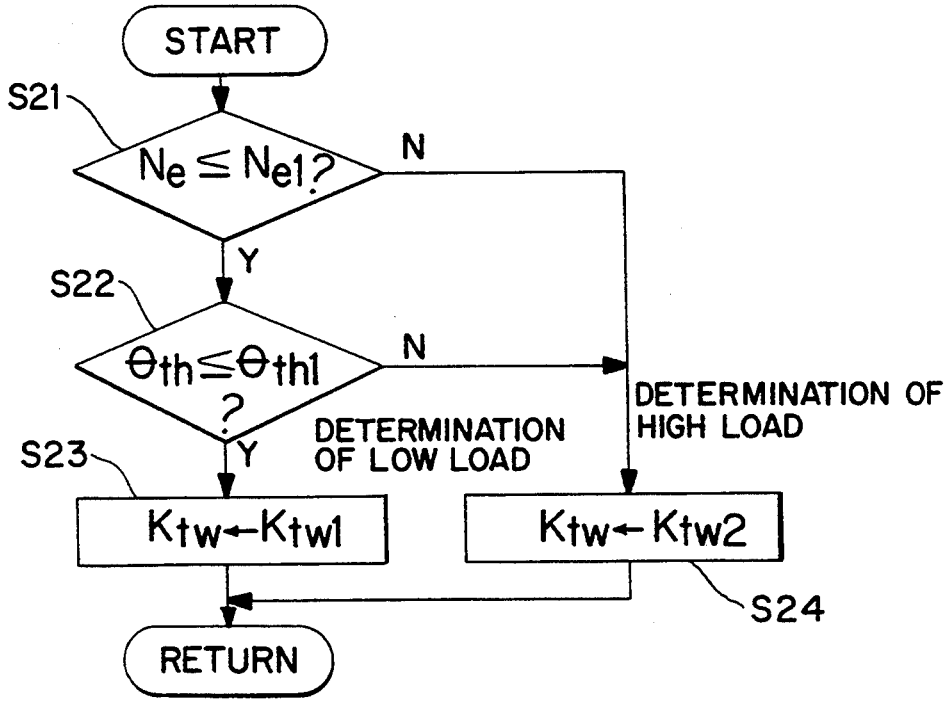
FIG. 6 is a flow chart illustrating the process for selecting either the $K_{tw1}$ Table, or the $K_{tw2}$ Table.

The selection of the line $K_{tw1}$ or $K_{tw2}$ according to a load condition may be carried out in accordance with the process illustrated in FIG. 6. In this process, at step S21, it is determined whether or not an engine speed $N_e$ is greater than a predetermined speed $N_{e1}$. If the engine speed $N_e$ is greater than the predetermined speed $N_{e1}$, the load condition is determined as a high load condition, and the line $K_{tw2}$ is selected at step S24. Thus, the data read according to the cooling water temperature $T_w$ from the line $K_{tw2}$ is set to be the first water temperature correction factor $K_{tw}$.

On the other hand, if the engine speed $N_e$ is less than the predetermined speed $N_{e1}$, it is determined at step S22 whether or not a throttle opening $\theta_{th}$ is greater than a predetermined opening $\theta_{th1}$. If the throttle opening $\theta_{th}$ is greater than the predetermined opening $\theta_{th1}$, the load condition is determined as a high load condition, and the program proceeds to step S24. If the throttle opening $T_h$ is less than the predetermined opening $\theta_{th1}$ the load condition is determined as a low load condition, and the line $K_{tw1}$ is selected at step S23. Thus, the data read according to the cooling water temperature $T_w$ from the line $K_{tw1}$ is set as the first water temperature correction factor $K_{tw}$.

Figure 7:
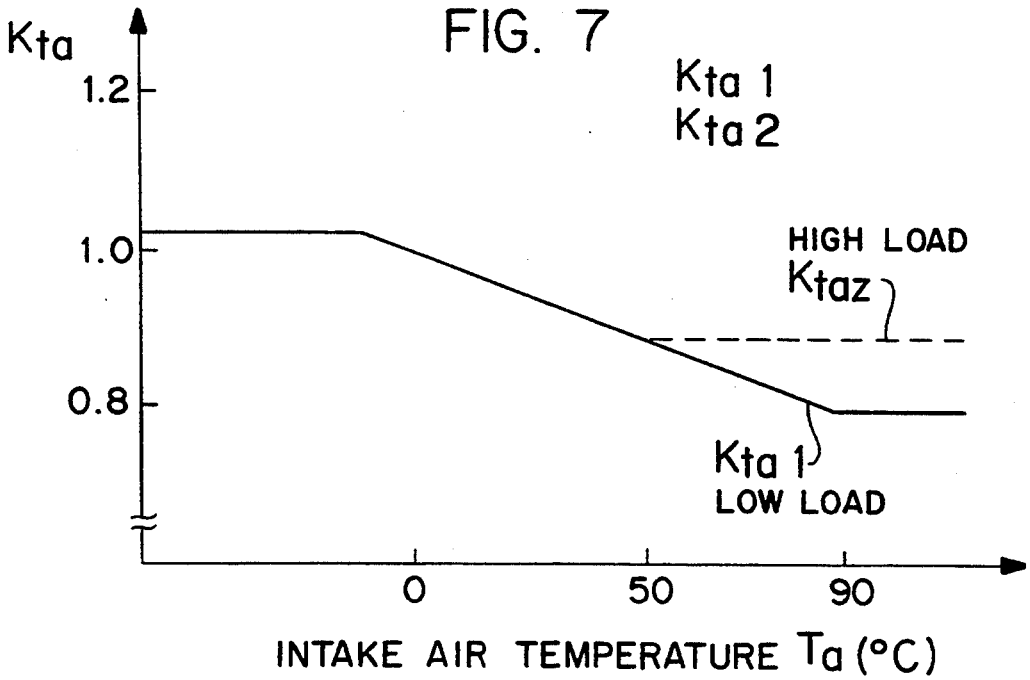
FIG. 7 is a graph illustrating the contents of $K_{ta1}$ Table and $K_{ta2}$ Table.

As illustrated in FIG. 3, the intake air temperature correction factor $K_{ta}$ is calculated at step S2. More specifically, either a line $K_{ta1}$ or a line $K_{ta2}$, as shown in FIG. 7, is selected according to whether the engine is in a low load condition or a high load condition. $K_{ta1}$ data or $K_{ta2}$ data is read according to the intake air temperature $T_a$ wherein the data is set to the intake air temperature correction factor $K_{ta}$.

The lines $K_{ta1}$ and $K_{ta2}$, as shown in FIG. 7, are common when the intake air temperature $T_a$ is not higher than about 50° C., and the slope of the line $K_{ta2}$ is 0 when the intake air temperature $T_a$ is greater than about 50° C. Alternatively, the slope of the line Kta2 can be smaller than the slope of the line $K_{ta1}$ when the intake air temperature $T_a$ is greater than about 50° C.

Figure 8:
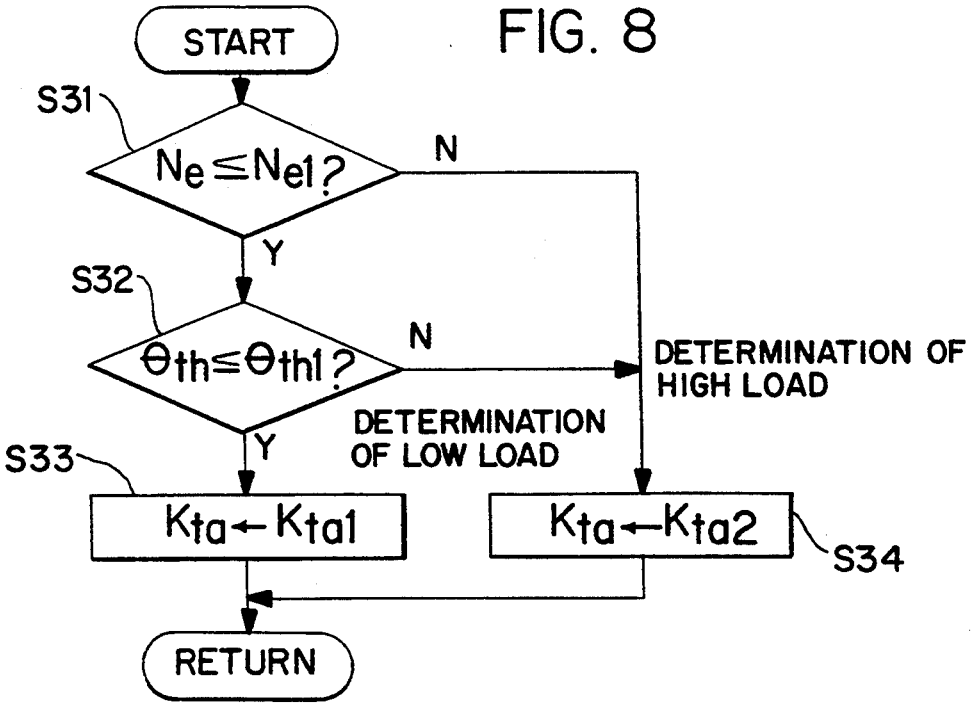
FIG. 8 is a flow chart illustrating the process for selecting either the $K_{a1}$ Table or the $K_{ta2}$ Table.

The selection of the line $K_{ta1}$ or the line $K_{ta2}$ is based upon a load condition of the engine as illustrated in FIG. 8. Since the details of this procedure are similar to those described above with respect to FIG. 6, the precise description of this procedure shown in FIG. 8 will be omitted for the sake of brevity.

Figure 9:
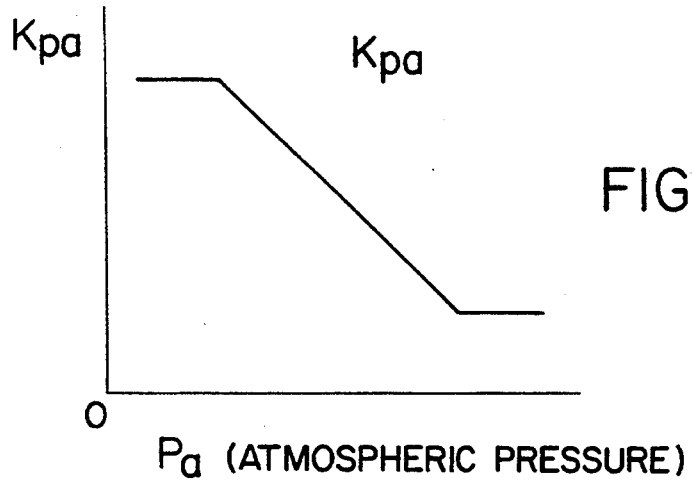
FIG. 9 is graph illustrating the contents of a $K_{pa}$ Table.

As illustrated in FIG. 3, the atmospheric pressure correction $K_{pa}$ is calculated at step S3. More specifically, the atmospheric pressure correction factor $K_{pa}$ is calculated according to an atmospheric pressure $P_a$ from a Table illustrated in FIG. 9.

At step S4, the first fundamental fuel injection quantity correction factor $K_{total}$ is calculated utilizing the following equation:

$$K_{total}=K_{tw}\times K_{ta}\times K_{pa} \quad (1)$$

At step S5, the acceleration incremental fuel injection quantity correction factor $K_{acc}$ is calculated utilizing the following equation:

$$K_{acc}=K_{twt}\times K_{ta}\times K_{pa} \quad (2)$$

Figure 10:
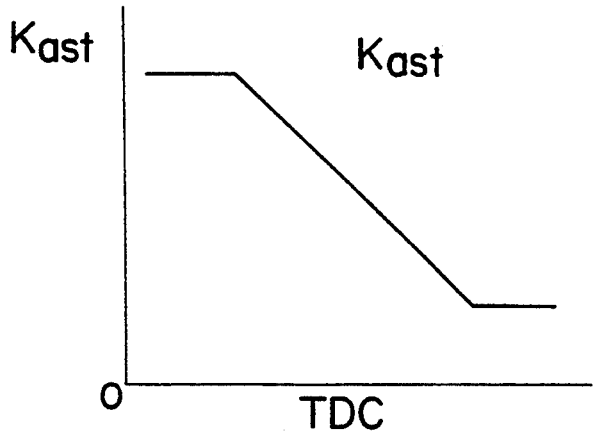
FIG. 10 is a graph illustrating the contents of a $K_{ast}$ Table.

At step S6 the second fundamental fuel injection quantity correction factor $K_{ast}$ is calculated. More specifically, the second fundamental fuel injection quantity correction factor $K_{ast}$ is calculated from a Table as illustrated in FIG. 10 according to the number of TDC pulses accumulated from the start of the operations of the engine.

Figure 13:
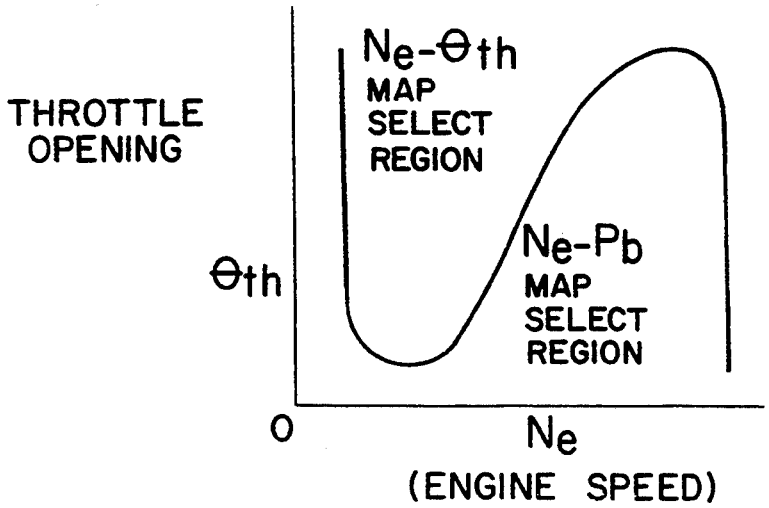
FIG. 13 is a graph illustrating the relationship between a throttle opening $\theta$th in an engine speed $N_e$ for selecting either the $N_{e\text{-}\theta th}$ map or the $N_{e\text{-}Pb}$ map.
Figure 11:
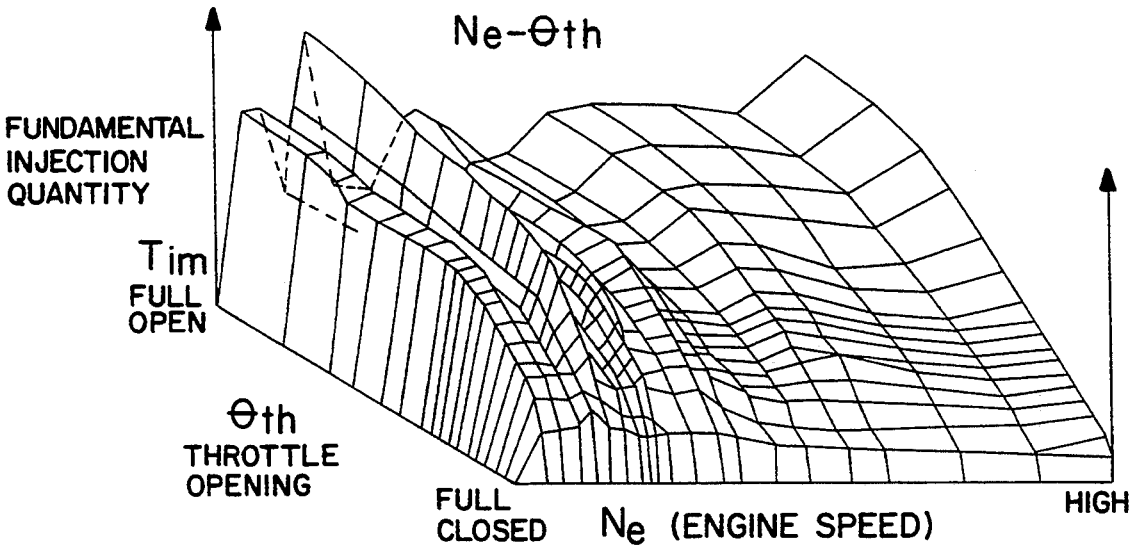
FIG. 11 is graph illustrating the contents of an $N_{e\text{-}\theta th}$ map.
Figure 12:
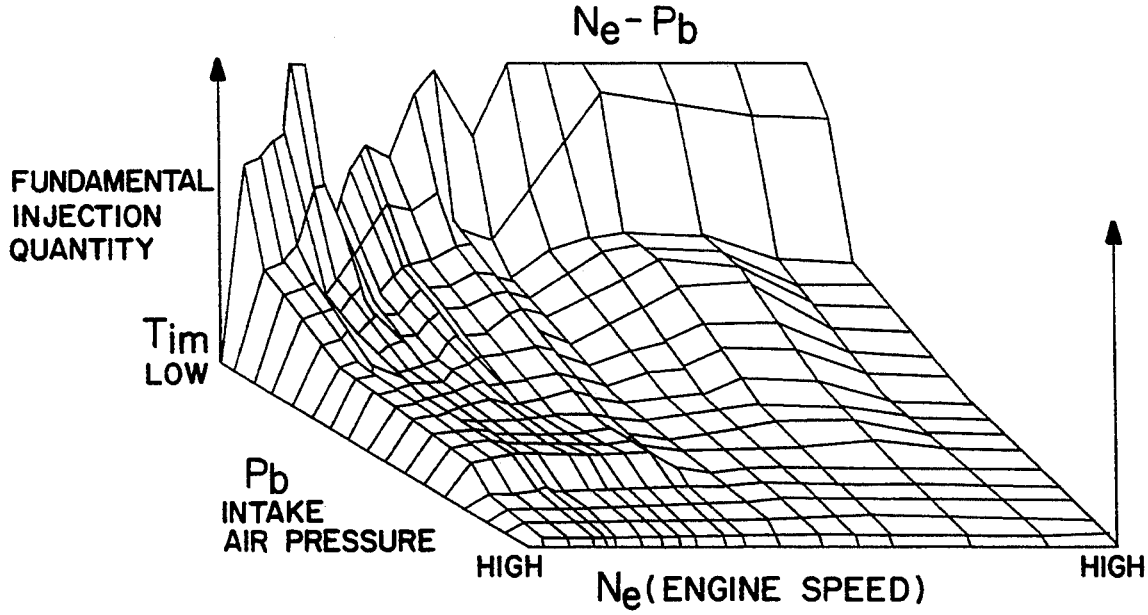
FIG. 12 is a graph illustrating the contents of an $N_e$-$P_b$ map.

At step S7, the fundamental fuel injection quantity $T_{im}$ is calculated. More specifically, either the $N_e-\Theta_{th}$ map shown in FIG. 11 or in $N_e-P_b$ map illustrated in FIG. 12 is selected according to the throttle opening $\Theta_{th}$ and the engine speed $N_e$ such that the fundamental fuel quantity $T_{im}$ is read from the selected map according to $N_e$ and $\Theta_{th}$ or an intake air pressure $P_b$. The selection of the $N_e-\Theta_{th}$ map or the $N_e-P_b$ map can be carried out by utilizing a region selecting Table as illustrated in FIG. 13.

In the $N_e-P_b$ map as illustrated in FIG. 12, the magnitude relation shown along the axis of the intake air pressure $P_b$ is adapted such that the intake air pressure $P_b$ is represented as an absolute pressure. If the intake air pressure $P_b$ is represented as a negative pressure, the magnitude relation of the intake air pressure $P_b$ is reversed.

At step S8, the fundamental fuel injection quantity $T_{im}$ calculated above is corrected by utilizing the following equation:

$$T_{im}=T_{im}\times K_{ast}\times K_{total} \quad (3)$$

At step S9, the acceleration incremental fuel injection quantity $T_{acc}$ is set. The acceleration incremental fuel injection quantity $T_{acc}$ is a fixed value, for example. While the process illustrated in FIG. 3 is executed upon the interruption of the crank pulses as mentioned above, a predetermined number of times of this execution may be set as a single unit. In this single unit, the acceleration incremental fuel injection quantity $T_{acc}$ may be set to a fixed value for a corresponding number of times that a vehicle accelerates. Moreover, this value may be set to 0 for the remaining number of times.

Alternatively, the acceleration incremental fuel injection quantity $T_{acc}$ may be set according to the acceleration of the vehicle.

At step S10, the acceleration incremental fuel injection quantity $T_{acc}$ is corrected by utilizing the following equation:

$$T_{acc}=T_{acc}\times K_{acc} \quad (4)$$

At step S11, the fuel injection quantity $T_{out}$ is calculated from the following equation:

$$T_{out}=T_{im}+T_{acc}+T_v \quad (5)$$

In equation (5), $T_{im}$ and $T_{acc}$ are the values respectfully corrected at steps S8 and S10. The voltage incremental injection quantity $T_v$ is obtained from a Table illustrated in FIG. 14 according to the battery voltage $V_b$. The voltage incremental injection quantity $T_v$ is calculated for a fixed period of time, for example.

Figure 14:
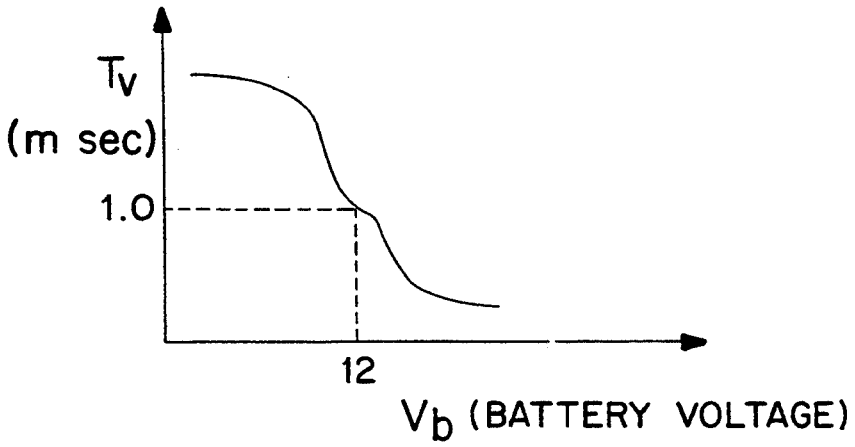
FIG. 14 is a graph illustrating the contents of a $T_v$ Table.

In FIG. 14, the unit of the voltage incremental fuel injection quantity $T_v$ represented by the ordinate access is time, which is an excitation time of the injector 29, and the excitation time corresponds to a fuel injection quantity.

The fuel injection quantity $T_{out}$, upon calculation, is inputted into a driving circuit for the injector 29. The excitation time (or excitation duty ratio) of the injector 29 is controlled according to the fuel injection quantity $T_{out}$.

The intake air temperature $T_a$, the engine speed $N_e$, the throttle opening $\Theta_{th}$, the cooling water temperature $T_w$, the atmospheric pressure $P_a$, and the intake air pressure $P_b$ are detected or computed by known methods by an interruption process.

Figure 16:
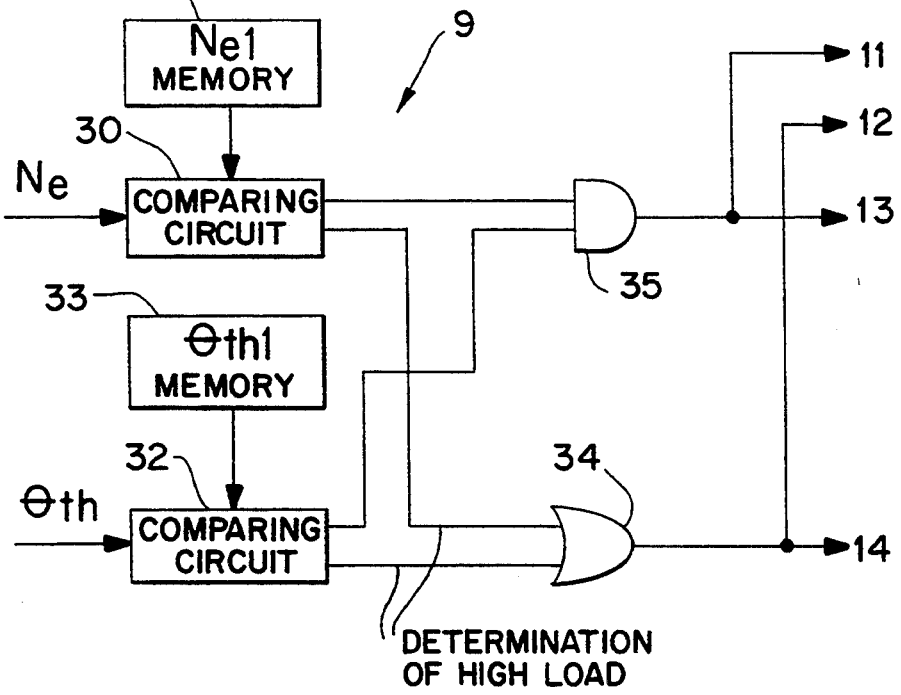
FIG. 16 is a block diagram illustrating the details of the load determining means illustrated in FIG. 15.
Figure 15:
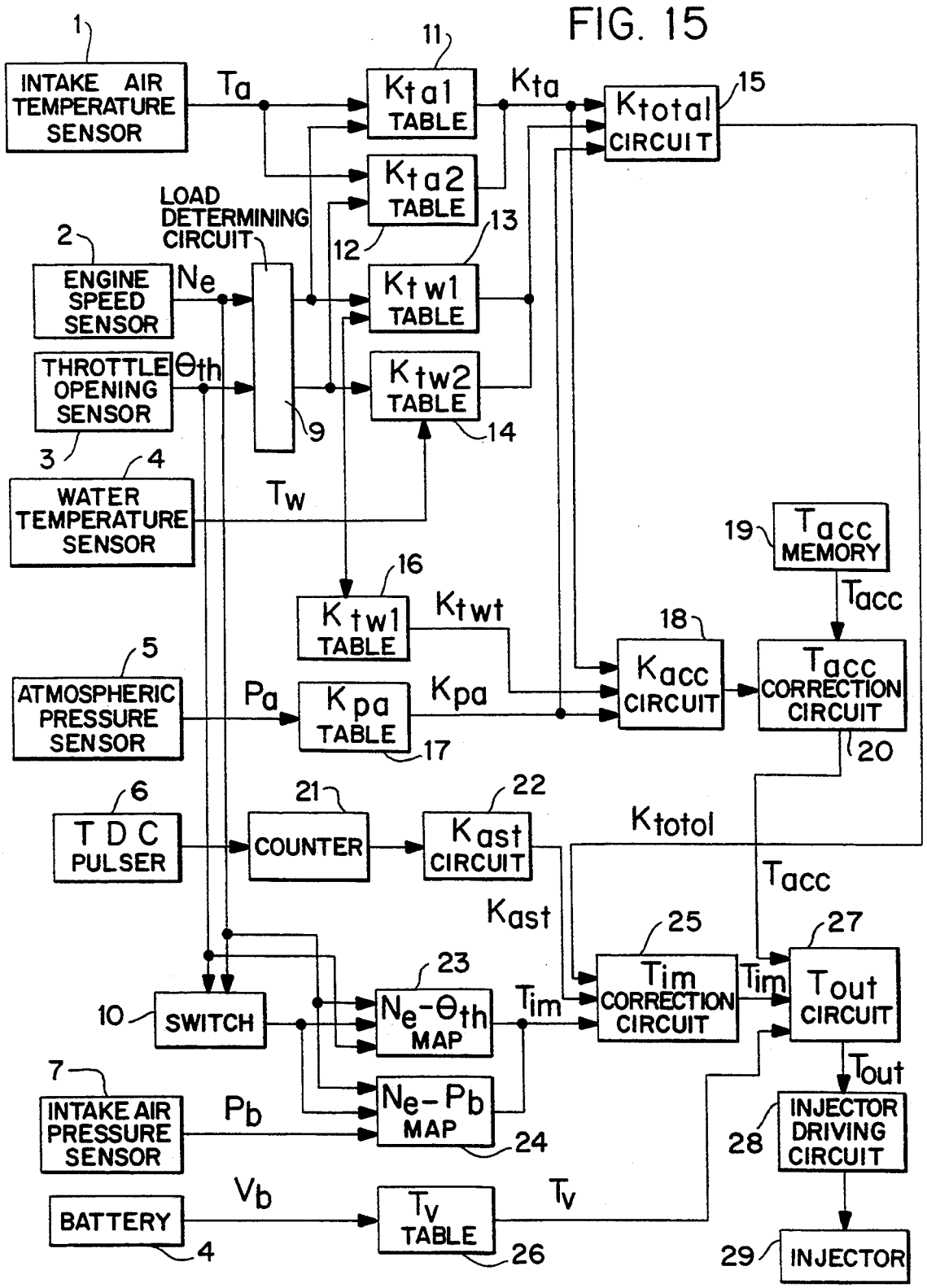
FIG. 15 is a block diagram of a preferred embodiment of the present invention.

FIG. 15 is a block diagram of a preferred embodiment of the present invention, and FIG. 16 is a block diagram illustrating the details of the load determining circuit 9 shown in FIG. 15. In FIG. 15, an engine speed sensor 2 functions as the crank pulser 2a and also functions to determine an engine speed $N_e$ by using output pulses from the crank pulser 2a. Further, a TDC pulser 6 functions to output TDC pulses by utilizing output pulses from the crank pulser 2a in the cam pulser 54.

As illustrated in FIG. 15, the load determining circuit 9 detects a low condition of the engine by using an engine speed $N_e$ and a throttle opening $\Theta_{th}$. More specifically, as illustrated in FIG. 16, a comparator 30 compares $N_e$ with a predetermined speed $N_{e1}$ stored in an $N_{e1}$ memory 31. If $N_e$ is greater than $N_{e1}$, the comparator determines that the engine is in a high load condition. Then, $K_{ta2}$ Table 12 and $K_{tw2}$ Table 14 are selected through an OR gate 34. Furthermore, the comparator 32 compares $\Theta_{th}$ with a predetermined opening $\Theta_{th1}$ stored in a $\Theta_{th1}$ memory 33. If $\Theta_{th}$ is greater than $\Theta_{th1}$, the comparator 32 determines that the engine is in a high load condition. Then, $K_{ta2}$ Table 12 and $K_{tw2}$ Table 14 are selected through the OR gate 34. If both the comparators 30 and 32 determine that the engine is not in a high load condition, $K_{ta1}$ Table 11 and $K_{tw1}$ Table 13 are selected through an AND gate 35.

$K_{ta1}$ or $K_{ta2}$ correspond to an intake air temperature $T_a$ read from the $K_{ta1}$ Table 11 or the $K_{ta2}$ Table 12 selected above. This data is inset to $K_{ta}$. Furthermore, $K_{tw1}$ or $K_{tw2}$ corresponds to a cooling water temperature $T_w$ read from the $K_{tw1}$ Table 13 or the $K_{tw2}$ Table 14 selected above and is set to $K_{tw}$.

Furthermore, $K_{twt}$ corresponding to $T_w$ is read from a $K_{twt}$ Table 16, and $K_{pa}$ corresponding to an atmospheric pressure $P_a$ is read from a $K_{pa}$ Table 17.

$K_{total}$ setting circuit computes the first fundamental fuel injection quantity correction factor $K_{total}$ by multiplying $K_{tw}$, $K_{ta}$, and $K_{pa}$. Furthermore, $K_{acc}$ setting circuit 18 computes the acceleration incremental fuel injection quantity correction factor $K_{acc}$ by multiplying $K_{twt}$, $K_{ta}$, and $K_{pa}$.

The selecting circuit 10 selects either the $N_e-\Theta_{th}$ map 23 or $N_e-P_b$ map 24 according to the relationship shown in FIG. 13 by utilizing the engine speed $N_e$ and a throttle opening $\Theta_{th}$. If the $N_e-\Theta_{th}$ map 23 is selected, the fundamental fuel injection quantity $T_{im}$ corresponding to $N_e$ and $\Theta_{th}$ is read from the $N_e-\Theta_{th}$ map 23. If the $N_e-P_b$ map 24 is selected, the fundamental fuel injection quantity $T_{im}$ corresponding to $N_e$ and an intake air pressure $P_b$ is read from the $N_e-P_b$ map 24.

The TDC pulses outputted from the TDC pulser 26 are inputted into a counter 21 such that the total number of TDC pulses is counted by the counter 21. The counted number of TDC pulses is inputted into $K_{ast}$ Table 22, in the second fundamental fuel injection quantity correction factor $K_{ast}$ corresponding to the counted number is read from the $K_{ast}$ Table 22.

A $T_{im}$ correcting circuit 25 corrects $T_{im}$ by multiplying the fundamental fuel injection quantity $T_{im}$ by the correction factors $K_{total}$ or $K_{ast}$ read from either map 23 or map 24.

A $T_{acc}$ correcting circuit 20 corrects an acceleration incremental fuel injection quantity read from the $T_{acc}$ memory 19 by multiplying the acceleration incremental fuel injection quantity $T_{acc}$ by the acceleration incremental fuel injection quantity correction factor $K_{acc}$.

A voltage incremental fuel injection quantity $T_v$ corresponding to a battery voltage $V_b$ is read from a $T_v$ Table 26.

A $T_{out}$ setting circuit 27 sets the fuel injection quantity $T_{out}$ by adding the corrected fundamental fuel injection quantity $T_{im}$, the corrected acceleration incremental fuel injection quantity $T_{acc}$, and the voltage incremental fuel injection quantity $T_v$. The fuel injection quantity $T_{out}$, thus computed, is inputted into an injector driving circuit 28.

FIG. 1 is a block diagram of the present invention as simplified from FIG. 15. In FIG. 1, the same reference numerals as shown in FIG. 15 designate the same or corresponding powers. As previously mentioned with reference to FIG. 15, the intake air temperature correction factor $K_{ta}$ is set according to an intake air temperature $T_a$. The intake air temperature correction factor $K_{ta}$ is different for a low load condition and high load condition for the engine. More specifically, when the engine is in a low load condition, low load intake air temperature correction factor setting circuit 11a is selected while when the engine is in a high load condition, high load intake air temperature correction factor setting circuit 12A is selected.

The setting circuits 11A or 12A set $K_{ta1}$ or $K_{ta2}$ according to an intake air temperature $T_a$ and outputs $K_{ta1}$ or $K_{ta2}$ as the intake air temperature correction factor $K_{ta}$ to a fuel injection quantity computing circuit 100. The fuel injection quantity computing circuit 100 computes a fuel injection quantity to be inputted into the injector driving circuit 28 by a suitable method while utilizing the intake air temperature correction factor $K_{ta}$.

A fundamental fuel injection quantity correction factor setting circuit 15A and an acceleration incremental fuel injection quantity correction factors setting circuit 18A set a fundamental fuel injection quantity correction factor and an acceleration incremental fuel injection quantity correction factor, respectfully, by using the intake air temperature correction factor $K_{ta}$. Furthermore, a fundamental fuel injection quantity setting circuit 23A sets a fundamental fuel injection quantity $T_{im}$ by utilizing an engine speed No, intake air pressure $P_b$, and throttle opening $\Theta_{th}$. An acceleration incremental fuel injection quantity setting circuit 19A sets an acceleration incremental fuel injection quantity $T_{acc}$.

The fundamental fuel injection quantity correcting circuit 25A and the acceleration incremental fuel injection quantity correcting circuit 20A correct the fundamental fuel injection quantity $T_{im}$ and the acceleration incremental fuel injection quantity $T_{acc}$, respectfully, by utilizing the fundamental fuel injection quantity correction factor and the acceleration incremental fuel injection quantity correction factor, respectfully, set by the setting circuits 15A and 18A. The fuel injection quantity setting circuit 27A determines a fuel injection quantity $T_{out}$ by utilizing the corrected $T_{im}$ and the corrected $T_{acc}$.

Figure 17:
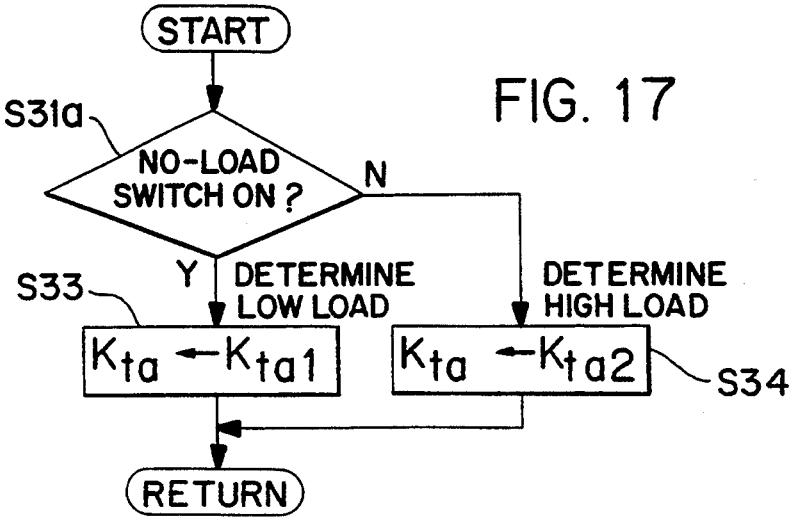
FIG. 17 is a flow chart illustrating another preferred embodiment for the selection of either the $K_{ta1}$ Table or the $K_{ta2}$ Table.

The load condition determining process for the selection of the Table shown in FIG. 8 can be carried out by the method as illustrated in FIG. 17. When a clutch for the vehicle is in an off condition or the transmission in the vehicle is in the neutral condition (i.e., a no load switch is on), it is determined that the engine is in a low load condition. On the other hand, when the clutch and the transmission are in the engaged condition, it is determined that the engine is in a high load condition. The no load switch mentioned above can be realized by the utilization of a microcomputer in the ECU 60. This load condition determining method may also be applied to the selection of the Table shown in FIG. 6.

Figure 18:
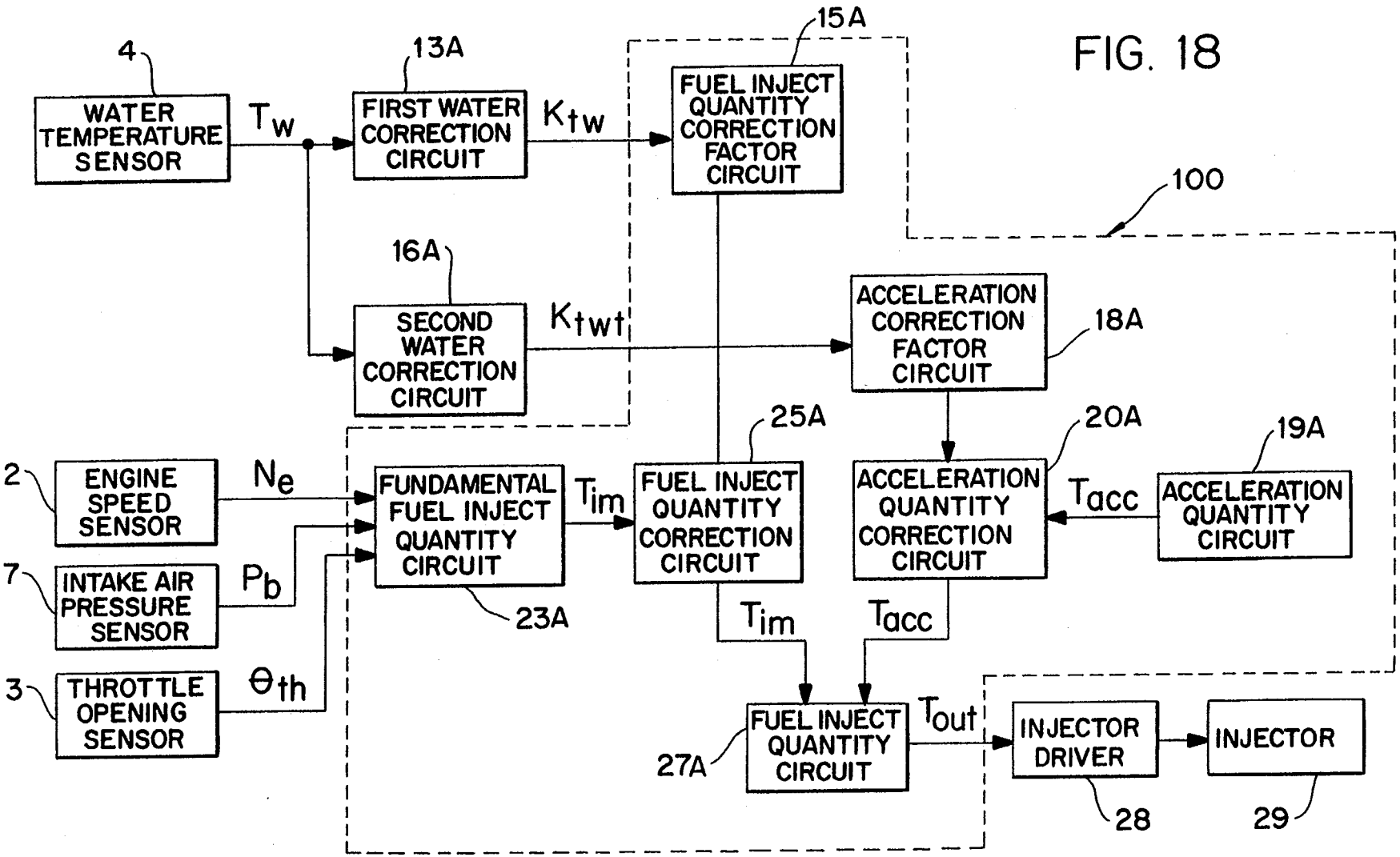
FIG. 18 is a block diagram of a second embodiment of the present invention.

FIG. 18 is a block diagram of the present invention as simplified from FIG. 15. In FIG. 18, the same reference numerals as those shown in FIG. 15 designate the same or corresponding parts.

A first water temperature correction factor setting circuit 13A sets a first water temperature correction factor $K_{tw}$ according to a cooling water temperature $T_w$ and outputs the first water temperature correction factor $K_{tw}$ to a fuel injection quantity computing circuit 100. Similarly, a second water temperature correction factor setting circuit 16A sets a second water temperature correction factor $K_{twt}$ according to the cooling water temperature $T_w$ and outputs the second water temperature correction factor $K_{twt}$ to the fuel injection quantity computing circuit 100.

More specifically, the first water temperature correction factor setting circuit 13A sets the first temperature correction factor $K_{tw}$ corresponding to $T_w$ by utilizing either $K_{tw1}$ Table 13 or the $K_{tw2}$ Table 14 or by utilizing an average between the $K_{tw1}$ Table 13 and the $K_{tw2}$ Table 14. The selection of the $K_{tw1}$ Table 13 and the $K_{tw2}$ Table 14 is carried out according to a load condition of the engine. The first water temperature correction factor $K_{tw}$ is set by using the selected Table. However, $K_{tw}$ may not be set according to a load condition of the engine.

Furthermore, the second water temperature correction factor setting circuit 16A sets the second water temperature correction factor $K_{twt}$ corresponding to $T_w$ by utilizing the $K_{tw}$ Table 16.

The fuel injection quantity computing circuit 100 computes a fundamental fuel injection quantity $T_{im}$ as a fuel injection quantity during the normal running condition of the engine. The fuel injection quantity computing circuit 100 also computes an acceleration incremental fuel injection quantity $T_{acc}$ as an increment of a fuel injection quantity during acceleration of the engine. The calculation of these quantities are in accordance with the first water temperature correction factor $K_{tw}$ and the second water temperature correction factor $K_{twt}$. Based upon these calculations, the fuel injection quantity computing circuit 100 computes the proper fuel injection quantity to be inputted into the injector driving circuit 28.

More specifically, a fundamental fuel injection quantity correction factor setting circuit 15A sets a fundamental fuel injection quantity correction factor by utilizing the first water temperature correction factor $K_{tw}$, and an acceleration incremental injection quantity correction factor setting circuit 18A sets an acceleration incremental injection quantity by using the second water temperature correction factor $K_{twt}$. Furthermore, a fundamental fuel injection quantity setting means 23A sets a fundamental fuel injection quantity $T_{im}$ by utilizing the engine speed $N_e$, intake air pressure $P_b$, and throttle opening $\Theta_{th}$. An acceleration incremental fuel injection quantity setting circuit 19A sets an acceleration incremental fuel injection quantity $T_{acc}$.

The fundamental fuel injection quantity correcting circuit 25A and the acceleration incremental fuel injection quantity correcting circuit 20A correct the fundamental fuel injection quantity $T_{im}$ and the acceleration incremental fuel injection quantity $T_{acc}$, respectfully, by utilizing the fundamental fuel injection quantity correction factor and the acceleration incremental fuel injection quantity correction factor, respectfully, set by the setting circuits 15A and 18A. The fuel injection quantity setting circuit 27A determines a fuel injection quantity $T_{out}$ by utilizing the corrected $T_{im}$ and the corrected $T_{acc}$.

The load condition determining process for the selection of the Tables shown in FIG. 8 can be carried out as shown in FIG. 17. When a clutch for a vehicle is in a off condition or a transmission of the vehicle is in a neutral condition (i.e., a no load switch is on), it is determined that the engine is in a low load condition. When the clutch or the transmission are in an engaged condition, it is determined that the engine is in a high load condition. The no load switch mentioned above can be realized by the microcomputer in the ECU 60.

While the present invention is applicable to a motorcycle in the above preferred embodiments, it is to be understood that the present invention is not limited to the preferred embodiments but may be applicable to a fuel injection control device for any internal combustion engine such as an automobile or the like.

According to the present invention, when a detected intake air temperature is high for a high load condition of the engine, an intake air temperature correction factor is established such that the intake air temperature is less influential upon the determination of the fuel injection quantity. Thus, even when the detected intake air temperature is higher than an actual intake air temperature, an intake air temperature correction factor similar to a correction factor for the actual intake air temperature can be set such that the measured intake air temperature is less influential. Accordingly, when an engine is experiencing a high load condition, the fuel injection quantity demanded by the engine can be obtained.

Also, the correction of the fundamental fuel injection quantity and the acceleration incremental fuel injection quantity can be realized by using different water temperature correction factors. Therefore, the fuel injection quantity during acceleration of the engine can be established to correspond to the actual demand of the engine. Since a fuel carburation rate at low engine temperature is low, a fuel injection quantity demanded by the engine at acceleration is very large. Accordingly, the fuel injection control device of the present invention utilizes a second water temperature correction factor which can be set at a larger value than the first water temperature correction factor at low engine temperatures. Therefore, the fuel injection quantity for acceleration of the engine at low engine temperatures can be established in accordance with that actually demanded by the engine.

While only certain embodiments of the present invention have been described, it will be apparent to those skilled in the art that various changes and modifications may be made therein without departing from the spirit and scope of the present invention as set forth in the claims below.

What we claim is:

1. A fuel injection control device for an internal combustion engine, comprising:

fundamental fuel injection quantity setting means for establishing a fundamental fuel injection quantity as a fuel injection quantity during normal operation of the engine;

fundamental fuel injection quantity correction factor setting means for establishing a fundamental fuel injection quantity correction factor;

fundamental fuel injection quantity correcting means for correcting said fundamental fuel injection quantity by said fundamental fuel injection quantity correction factor;

acceleration incremental fuel injection quantity setting means for establishing an acceleration incremental fuel injection quantity as an increment of said fuel injection quantity during acceleration of the engine;

acceleration incremental fuel injection quantity correction factor setting means for establishing an acceleration incremental fuel injection quantity correction factor;

acceleration incremental fuel injection quantity correcting means for correcting said acceleration incremental fuel injection quantity;

first water temperature correction factor setting means for establishing a first water temperature correction factor according to an engine temperature;

second water temperature correction factor setting means for establishing a second water temperature correction factor according to the temperature of the engine; and throttle detecting means for detecting an angle of a throttle of the engine;

said fundamental fuel injection quantity correction factor setting means establishing said fundamental fuel injection quantity correction factor according to said first water temperature correction factor;

said acceleration incremental fuel injection quantity correction factor setting means establishing said acceleration incremental fuel injection correction factor according to said second water temperature correction factor;

said fundamental fuel injection correcting means using said acceleration incremental fuel injection quantity correction factor when said throttle detecting means detects that the angle of the throttle is greater than a predetermined value.

2. The fuel injection control device as claimed in claim 1, wherein said first and second water temperature correction factors decrease as an engine temperature increases, said second water temperature correction factor decreasing faster than said first water temperature correction factor.

3. A fuel injection control device for an internal combustion engine, comprising:

load determining means for detecting a load condition of the engine;

first intake air temperature correction factor setting means for establishing a first intake air temperature correction factor when said load determining means detects high-load condition;

second intake air temperature correction factor setting means for establishing a second intake air temperature correction factor when said load determining means detects a low-load condition; and fuel injection quantity means for computing a fuel injection quantity according to either said first or second intake air temperature correction factor;

said second intake air temperature correction factor decreasing as an intake air temperature increases;

said first intake air temperature correction factor decreasing as the intake air temperature increases;

said first intake air temperature correction factor being a fixed value after th intake air temperature exceeds a predetermined value;

said load determining means having engine speed means for detecting a speed of the engine;

said load determining means determining the load condition based on the detected engine speed.

4. A fuel injection control method for an internal combustion engine, comprising the steps of:

(a) establishing a fundamental fuel injection quantity as a fuel injection quantity during normal operation of the engine;

(b) establishing a fundamental fuel injection quantity correction factor;

(c) correcting the fundamental fuel injection quantity by the fundamental fuel injection quantity correction factor;

(d) establishing an acceleration incremental fuel injection quantity as an increment of the fuel injection quantity during acceleration of the engine;

(e) establishing an acceleration incremental fuel injection quantity correction factor;

(f) correcting the acceleration incremental fuel injection quantity;

(g) establishing a first water temperature correction factor according to an engine temperature;

(h) establishing a second water temperature correction factor according to the temperature of the engine; and (i) detecting an angle of a throttle of the engine;

said step (b) establishing the fundamental fuel injection quantity correction factor according to the first water temperature correction factor;

said step (c) using the acceleration incremental fuel injection quantity correction factor when said step (i) detects that the angle of the throttle is greater than a predetermined value said step (e) establishing the acceleration incremental fuel injection correction factor according to the second water temperature correction factor.

5. The method as claimed in claim 4, wherein the first and second water temperature correction factors decrease as an engine temperature increases, the second water temperature correction factor decreasing faster than the first water temperature correction factor.

6. A fuel injection control method for an internal combustion engine, comprising the steps of:

(a) detecting a load condition of the engine;

(b) establishing a first intake air temperature correction factor when a high-load condition is detected;

(c) establishing a second intake air temperature correction factor when a low-load condition is detected;

(d) computing a fuel injection quantity according to either the first or second intake air temperature correction factor, the second intake air temperature correction factor decreasing as an intake air temperature increases, the first intake air temperature correction factor decreasing as the intake air temperature increases, the first intake air temperature correction factor being a fixed value after the intake air temperature exceeds a predetermined value; and wherein said step (a) comprises the step of:

(a1) detecting a speed of the engine;

said step (a) determining the load condition based on the detected engine speed.

7. The method as claimed in claim 6, wherein said step (a) comprises the step of:

(a2) detecting an angle of a throttle of the engine;

said step (a) determining the load condition based on the detected throttle angle.

8. A fuel injection control device for an internal combustion engine, comprising:

a fundamental fuel injection quantity circuit to establish a fundamental fuel injection quantity as a fuel injection quantity during normal operation of the engine;

a fundamental fuel injection quantity correction factor circuit to establish a fundamental fuel injection quantity correction factor;

a fundamental fuel injection quantity correcting circuit to correct said fundamental fuel injection quantity by said fundamental fuel injection quantity correction factor;

an acceleration incremental fuel injection quantity circuit to establish an acceleration incremental fuel injection quantity as an increment of said fuel injection quantity during acceleration of the engine;

an acceleration incremental fuel injection quantity correction factor circuit to establish an acceleration incremental fuel injection quantity correction factor;

an acceleration incremental fuel injection quantity correcting circuit to correct said acceleration incremental fuel injection quantity;

a first water temperature correction factor circuit to establish a first water temperature correction factor according to an engine temperature; p1 a second water temperature correction factor circuit to establish a second water temperature correction factor according to the temperature of the engine; and a throttle detecting circuit to detect an angle of a throttle of the engine;

said fundamental fuel injection quantity correction factor circuit establishing said fundamental fuel injection quantity correction factor according to said first water temperature correction factor;

said acceleration incremental fuel injection quantity correction factor circuit establishing said acceleration incremental fuel injection correction factor according to said second water temperature correction factor; and said fundamental fuel injection quantity correcting circuit using said acceleration incremental fuel injection quantity correction factor when said throttle detecting circuit detects that the angle of the throttle is greater than a predetermined value.

9. The fuel injection control device as claimed in claim 8, wherein said first and second water temperature correction factors decrease as an engine temperature increases, said second water temperature correction factor decreasing faster than said first water temperature correction factor.

10. A fuel injection control device for an internal combustion engine, comprising:

a load detecting circuit to detect a load condition of the engine;

a first intake air temperature correction factor circuit to establish a first intake air temperature correction factor when said load detecting circuit detects a high-load condition;

a second intake air temperature correction factor circuit to establish a second intake air temperature correction factor when said load detecting circuit detects a low-load condition; and a fuel injection quantity circuit to computer a fuel injection quantity according to either said first or second intake air temperature correction factors;

said second intake air temperature correction factor decreasing as an intake air temperature increases;

said first intake air temperature correction factor decreasing as the intake air temperature increases;

said first intake air temperature correction factor being a fixed value after the intake air temperature exceeds a predetermined value;

said load detecting circuit includes an engine speed sensor to detect a speed of the engine;

said load detecting circuit determining the load condition based on the detected engine speed.

11. The fuel injection control device as claimed in claim 10, wherein said load detecting circuit comprises:

a throttle opening sensor to detect an angle of a throttle of the engine;

said load detecting circuit determining the load condition based on the detected throttle angle.

12. A fuel injection control device for an internal combustion engine for controlling a fuel injection quantity according to a fundamental fuel injection correction factor or an acceleration correction factor, comprising:

first water temperature correction factor setting means for establishing a first water temperature correction factor according to an engine temperature;

second water temperature correction factor setting means for establishing a second water temperature correction factor according to the temperature of the engine;

fundamental fuel injection quantity correction factor setting means for establishing a fundamental fuel injection quantity correcting factor according to said first water temperature correction factor;

acceleration incremental fuel injection quantity correction factor setting means for establishing an acceleration correction factor according to said second water temperature correction factor;

throttle detecting means for detecting an angle of a throttle of the engine; and fundamental fuel injection correcting means for controlling a fuel injection quantity;

said fundamental fuel injection correcting means using said acceleration incremental fuel injection quantity correction factor when said throttle detecting means detects that the angle of the throttle is greater than a predetermined value.

13. The fuel injection control device as claimed in claim 12, wherein said first and second water temperature correction factors decrease as an engine temperature increases, said second water temperature correction factor decreasing faster than said first water temperature correction factor.

14. A fuel injection control method for an internal combustion engine for controlling a fuel injection quantity according to a fundamental fuel injection correction factor or an acceleration correction factor, comprising the steps of:

(a) establishing a first water temperature correction factor according to an engine temperature;

(b) establishing a second water temperature correction factor according to the temperature of the engine;

(c) establishing a fundamental fuel injection quantity correction factor according to the first water temperature correction factor;

(d) establishing an acceleration incremental fuel injection correction factor according to the second water temperature correction factor;

(e) detecting an angle of a throttle of the engine; and (f) using the acceleration incremental fuel injection quantity correction factor when said step (e) detects that the angle of the throttle is greater than a predetermined value.

15. The method as claimed in claim 14, wherein the first and second water temperature correction factors decrease as an engine temperature increases, the second water temperature correction factor decreasing faster than the first water temperature corrections factor.

16. A fuel injection control device for an internal combustion engine for controlling a fuel injection quantity according to a fundamental fuel injection correction factor or an acceleration correction factor, comprising:

a first water temperature correction factor circuit to establish a first water temperature correction factor according to an engine temperature;

a second water temperature correction factor circuit to establish a second water temperature correction factor according to the temperature of the engine;

a fundamental fuel injection quantity correction factor circuit to establish a fundamental fuel injection quantity correction factor according to said first water temperature correction factor;

an acceleration incremental fuel injection quantity correction factor circuit to establish an acceleration incremental fuel injection correction factor according to said second water temperature correction factor;

a throttle opening sensor for detecting an angle of a throttle of the engine; and fundamental fuel injection correcting means for controlling a fuel injection quantity;

said fundamental fuel injection correcting means using said acceleration incremental fuel injection quantity correction factor when said throttle opening sensor detects that the angle of the throttle is greater than a predetermined value.

17. The fuel injection control device as claimed in claim 16, wherein said first and second water temperature correction factors decrease as an engine temperature increases, said second water temperature correction factor decreasing faster than said first water temperature correction factor.

18. A fuel injection control device for an internal combustion engine, comprising:

load determining means for detecting a load condition of the engine;

first intake air temperature correction factor setting means for establishing a first intake air temperature correction factor when said load determining means detects high-load condition;

second intake air temperature correction factor setting means for establishing a second intake air temperature correction factor when said load determining means detects a low-load condition; and fuel injection quantity means for computing a fuel injection quantity according to either said first or second intake air temperature correction factor;

said second intake air temperature correction factor decreasing as an intake air temperature increases;

said first intake air temperature correction factor decreasing as the intake air temperature increases;

said first intake air temperature correction factor being a fixed value after the intake air temperature exceeds a predetermined value;

said load determining means having throttle detecting means for detecting an angle of a throttle of the engine;

said load determining means determining the load condition based on the detected throttle angle.

* * * * *